US006117825A

United States Patent [19]

Liu et al.

[11] Patent Number: 6,117,825

[45] **Date of Patent: *Sep. 12, 2000**

[54] POLYISOBUTYLENE SUCCINIMIDE AND ETHYLENE-PROPYLENE SUCCINIMIDE SYNERGISTIC ADDITIVES FOR LUBRICATING OILS COMPOSITIONS

[75] Inventors: Christopher Soundang Liu, Poughkeepsie; Cyril Andrew Migdal, Croton-on-Hudson; Norris Roland Crawford, Beacon; Roy Isamu Yamamota, Hopewell Junction, all of N.Y.

[73] Assignee: Ethyl Corporation, Richmond, Va.

[ * ] Notice: This patent is subject to a terminal disclaimer.

[21] Appl. No.: 07/879,401

[22] Filed: May 7, 1992

[51] Int. Cl.[7] ..... C10M 149/06; C10M 133/16

[52] U.S. Cl. ..... 508/291; 508/290; 508/293

[58] Field of Search ..... 252/515 A; 508/291

[56] References Cited

U.S. PATENT DOCUMENTS

| | | | |
|---|---|---|---|
| 4,482,464 | 11/1984 | Karol et al. | 252/51.5 R |
| 4,636,322 | 1/1987 | Nalesnik | 252/52 A |
| 4,699,724 | 10/1987 | Nalesnik et al. | 252/56 R |
| 5,075,383 | 12/1991 | Migdal et al. | 252/47.5 |

*Primary Examiner*—Ellen M. McAvoy
*Attorney, Agent, or Firm*—Dennis H. Rainear; Thomas Hamilton

[57] ABSTRACT

A lubricating oil composition comprising:

(a) a major amount of an oil of lubricating viscosity; and (b) a minor dispersant amount of a synergistic combination of an antioxidant-dispersant additive and a dispersant additive, said combination comprising:

(i) a polyisobutylene succinimide; and (ii) an ethylene-propylene succinimide.

23 Claims, 7 Drawing Sheets

POLYISOBUTYLENE SUCCINIMIDE AND ETHYLENE-PROPYLENE SUCCINIMIDE SYNERGISTIC ADDITIVES FOR LUBRICATING OILS COMPOSITIONS

BACKGROUND OF THE INVENTION

This invention relates to lubricating oil compositions and more particularly to polyisobutylene succinimide dispersants and ethylene-propylene succinimide antioxidant-dispersants for single grade and multigrade lubricating oil compositions.

Internal combustion engines operate under a wide range of temperatures including low temperature stop-and-go service as well as high temperature conditions produced by continuous high speed driving. Stop-and-go driving, particularly during cold, damp weather conditions, leads to the formation of a sludge in the crankcase and in the oil passages of a gasoline or a diesel engine. This sludge seriously limits the ability of the crankcase oil to effectively lubricate the engine. In addition, the sludge with its entrapped water tends to contribute to rust formation in the engine. These problems tend to be aggravated by the manufacturer's lubrication service recommendations which specify extended oil drain intervals.

It is known to employ nitrogen containing dispersants and/or detergents in the formulation of crankcase lubricating oil compositions. Many of the known dispersant/detergent compounds are based on the reaction of an alkenylsuccinic acid or anhydride with an amine or polyamine to produce an alkylsuccinimide or an alkenylsuccinamic acid as determined by selected conditions of reaction.

Also it is known to chlorinate alkenylsuccinic acid or anhydride prior to the reaction with an amine or polyamine in order to produce a reaction product in which a portion of the amine or polyamine is attached directly to the alkenyl radical of the alkenyl succinic acid or anhydride. The thrust of many of these processes is to produce a product having a relatively high level of nitrogen in order to provide improved dispersancy in a crankcase lubricating oil composition.

With the introduction of four cylinder internal combustion engines which must operate at relatively higher engine speeds or RPM's than conventional 6-and 8-cylinder engines in order to produce the required torque output, it has become increasingly difficult to provide a satisfactory dispersant lubricating oil composition.

The conventional sludge dispersants for lubricating oils have been of the polyisobutenyl succinimide (PIBSAD) type for over 20 years. Recent changes in test procedures have made it more difficult to qualify these types of dispersants for use in single grade or multigrade lubricating oils without substantially increasing their treating dosage.

Thus, it is an object of the present invention to provide an effective lubricating oil composition for single-grade and multigrade lubricating oils.

DISCLOSURE STATEMENT

U.S. Pat. No. 4,713,189 discloses a lubricating oil composition having improved dispersancy and viton seal compatibility. The dispersant being prepared by coupling two polyethyleneamines with an aldehyde and a phenol, followed by conversion to a succinimide. The resulting coupled succinimide is then acylated with glycolic acid to form a glycolated Mannich phenol coupled mono-alkenyl succinimide.

U.S. Pat. No. 4,699,724 discloses a lubricating oil composition having improved dispersancy and Viton seal compatibility. The dispersant being prepared by coupling two mono-alkenyl succinimides with an aldehyde and phenol. The resulting coupled succinimide is then acylated with glycolic acid to form a glycolated Mannich phenol coupled mono-alkenyl succinimide.

U.S. Pat. No. 4,636,322 discloses a lubricating oil composition having improved dispersancy and Viton seal compatibility. The dispersant being prepared by coupling partly glycolated succinimides with an aldehyde and a phenol.

U.S. Pat. No. 4,089,794 discloses ethylene copolymers derived from about 2 to 98 wt. % ethylene, and one or more $C_3$ to $C_{12}$ alpha olefins, e.g. ethylene-propylene, are solution-grafted under an inert atmosphere and at elevated temperatures with an ethylenically-unsaturated carboxylic acid material in the presence of a high-temperature decomposable free-radical initiator and thereafter reacted with a polyfunctional material reactive with carboxyl groups, such as (a) a polyamine, or (b) a polyol, or (c) a hydroxylamine, or mixtures thereof, to form carboxyl-grafted polymeric derivatives, which have good engine sludge and varnish control behavior in fuels and lubricating oils. If the molecular weight is above 10,000 then these polymers are also useful as multifunctional viscosity index improvers.

U.S. Pat. Nos. 4,137,185 and 4,144,181 disclose ethylene copolymers, derived from about 2 to 98 wt. % ethylene, and one or more $C_3$–$C_{28}$ alpha-olefins, e.g. propylene, which are grafted, preferably solution-grafted under an inert atmosphere and at elevated temperatures and in the presence of a high-temperature, decomposable free-radical initiator, with an ethylenically-unsaturated dicarboxylic acid material and thereafter reacted with a polyamine having at least two primary amine groups, e.g. an alkylene polyamine such as diethylene triamine, to form carboxyl-grafted polymeric imide, usually maleimide, derivatives are reacted with an anhydride of a ($C_1$–$C_{30}$) hydrocarbyl substituted acid, preferably acetic anhydride, to yield an oil-soluble stable amide of said polyamine whereby oil solutions of said amide derivative are characterized by minimal viscosity change over an extended period of time. Useful number average molecular weight ($M_n$) of said copolymers range from about 700 to 500,000; however, if the molecular weight is from 10,000 to 500,000 then these copolymers are also useful as multifunctional viscosity index improvers.

U.S. Pat. No. 4,146,489 discloses graft copolymers wherein the backbone polymer is a rubbery, oil soluble ethylene-propylene copolymer or ethylene-propylene diene modified terpolymer and the graft monomer is a C-vinylpyridine or N-vinylpyrrolidone impart dispersant properties to hydrocarbon fuels and combined viscosity index improvement and dispersant properties to lubricating oils for internal combustion engines. The graft copolymers are prepared by intimate admixture of backbone polymer, graft monomer and free radical initiator at a temperature below initiation temperature, followed by a temperature increase to or above initiation temperature, thus providing a product containing little or no byproduct.

U.S. Pat. No. 4,320,019 discloses reaction products prepared by reacting (a) interpolymers of ethylene, one or more $C_3$–$C_8$ a-monoolefins, and one or more polyene selected from non-conjugated dienes and trienes, with (b) one or more olefinic carboxylic acid acylating agents to form an acylating reaction intermediate which is further reacted with (c) an amine.

These reaction products have been found useful as multifunctional additives to a variety of lubricating oils for enhancing their dispersancy as well as improving their viscosity-temperature relationship.

U.S. Pat. No. 4,340,689 discloses a process for grafting functional organic groups onto EPM and EPDM polymers wherein the grafting reaction is carried out in the cement in which the polymer is originally formed by solution polymerization.

U.S. Pat. No. 4,357,250 discloses compositions useful as dispersant and viscosity modifiers in lubricants are produced by (1) preparing an ene reaction intermediate from an olefinic carboxylic acid or derivative thereof (preferably maleic anhydride) and a terpolymer of ethylene, a $C_3$–$C_8$ a-monoolefin and a non-conjugated diene or triene, and (II) reacting said ene reaction intermediate with monoamine-polyamine mixture.

U.S. Pat. No. 4,382,007 discloses a dispersant VI improvers prepared by reacting a polyamine-derived dispersant with an oxidized ethylene-propylene polymer or ethylene-propylene-diene terpolymer. The products thus formed have a dispersancy superior to that obtained by separately blending the reactants in a lubricating oil. Also, disclosed are oils containing the present dispersant VI improvers.

U.S. Pat. No. 4,482,464 discloses a lubricating oil composition comprising a major proportion of an oil of lubricating viscosity and a minor dispersant amount of a hydrocarbyl-substituted mono-and bis-succinimide compound having branched hydroxyacyl radicals.

U.S. Pat. No. 4,863,623 discloses an additive composition comprising a graft and amine-derivatized copolymer prepared from ethylene and at least one $C_3$–$C_{10}$ alpha-monoolefin and, optionally, a polyene selected from non-c-njugated dienes and trienes comprising from about 15 to 80 mole percent of ethylene, from about 20 to 85 mole percent of said $C_3$–$C_{10}$ alpha monoolefin and from about 0 to 15 mole percent of said polyene having a average molecular weight ranging from about 5000 to 500,000 which has been reacted with at least one olefinic carboxylic acid acylating agent to form one or more acylating reaction intermediates characterized by having a carboxylic acid acylating function within their structure and reacting said reaction intermediate with an amino-aromatic polyamine compound from the group consisting of an N-arylphenylenediamine, an aminothiazole, an aminocarbazole, an amionindole, an aminopyrrole, an amino indazolinone, an aminomercaptotriazole, and an aminoperimidine to form said graft and amine-derivatized copolymer, and a lubricating oil composition containing same are provided.

U.S. Pat. No. 5,075,383 discloses an additive composition comprising a graft and amine-derivatized copolymer prepared from ethylene and at least one $C_3$–$C_{10}$ alpha-monoolefin and, optionally a polyene selected from non-conjugated dienes and trienes comprising from about 15 to 80 mole percent of ethylene, from about 20 to 85 mole percent of said $C_3$ to $C_{10}$ alpha-monoolefin and from about 0 to 15 mole percent of said polyene, said copolymer having a number average molecular weight ranging from about 5,500 to 50,000 and having grafted thereon at least 1.8 molecules of a carboxylic acid acylating function per molecule or said copolymer and reacting said grafted copolymer with an amino-aromatic polyamine compound from the group consisting of an N-arylphenylenediamine, an aminocarbazole, and an aminoperimidine to form said graft and amine-derivatized copolymer, and a lubricating oil composition containing same are provided.

The disclosures of U.S. Pat. No. 4,482,464; U.S. Pat. No. 4,713,489 and U.S. Pat. No. 5,075,383 are incorporated herein by reference.

SUMMARY OF THE INVENTION

This invention provides a lubricating oil composition comprising:

(a) a major amount of an oil of lubricating viscosity; and (b) a minor amount of a synergistic combination of an antioxidant-dispersant additive and a dispersant additive, said combination comprising:

(i) a polyisobutylene succinimide (PIBSAD); and (ii) an ethylene-propylene succinimide (LEPSAD).

DRAWINGS

The following drawings are provided to illustrate the present invention:

DETAILED DESCRIPTION OF THE INVENTION

Figure 1:
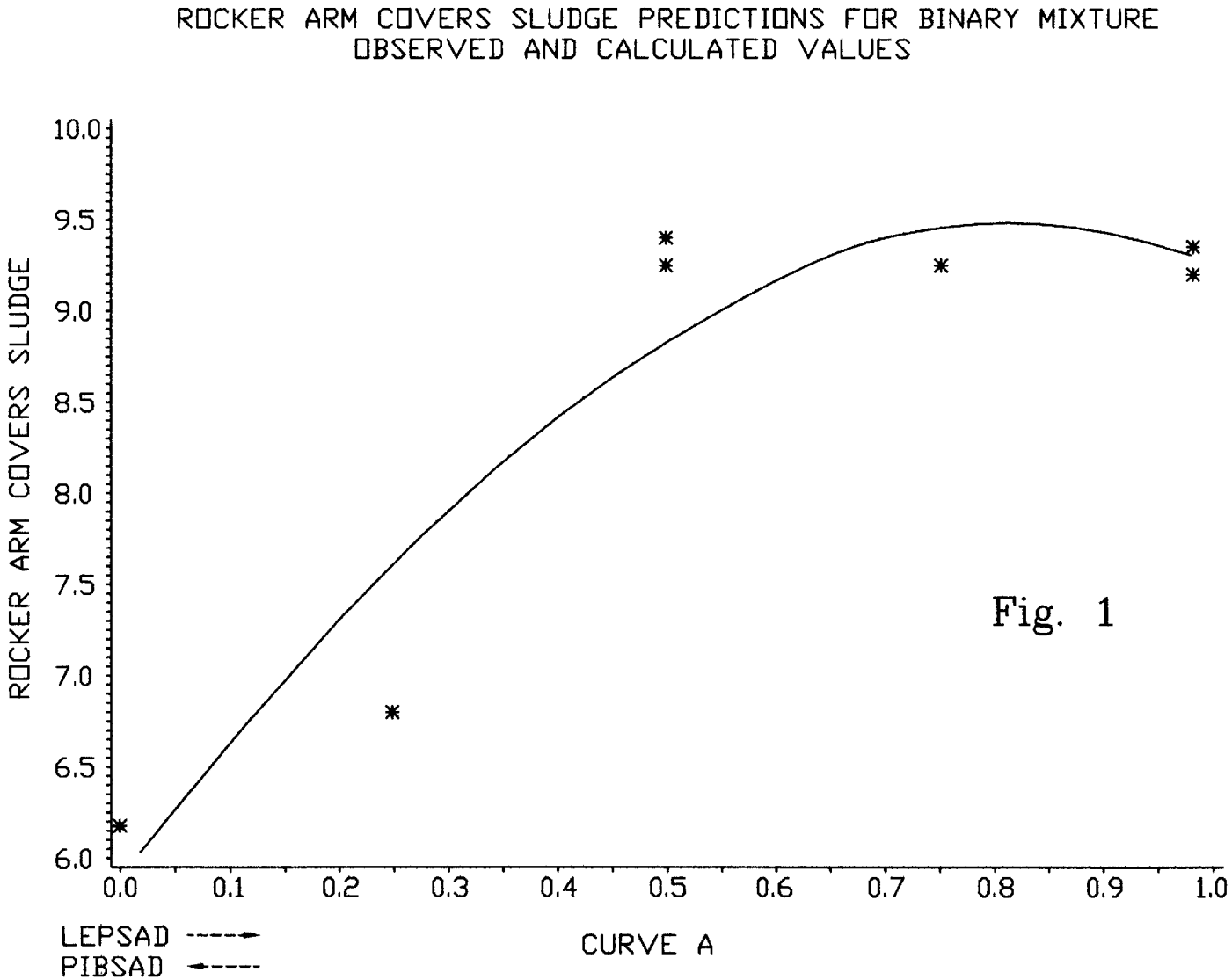
FIG. 1 is a graph of Rocker Arm Sludge predictions for Binary Mixture observed and calculated values.
Figure 2:
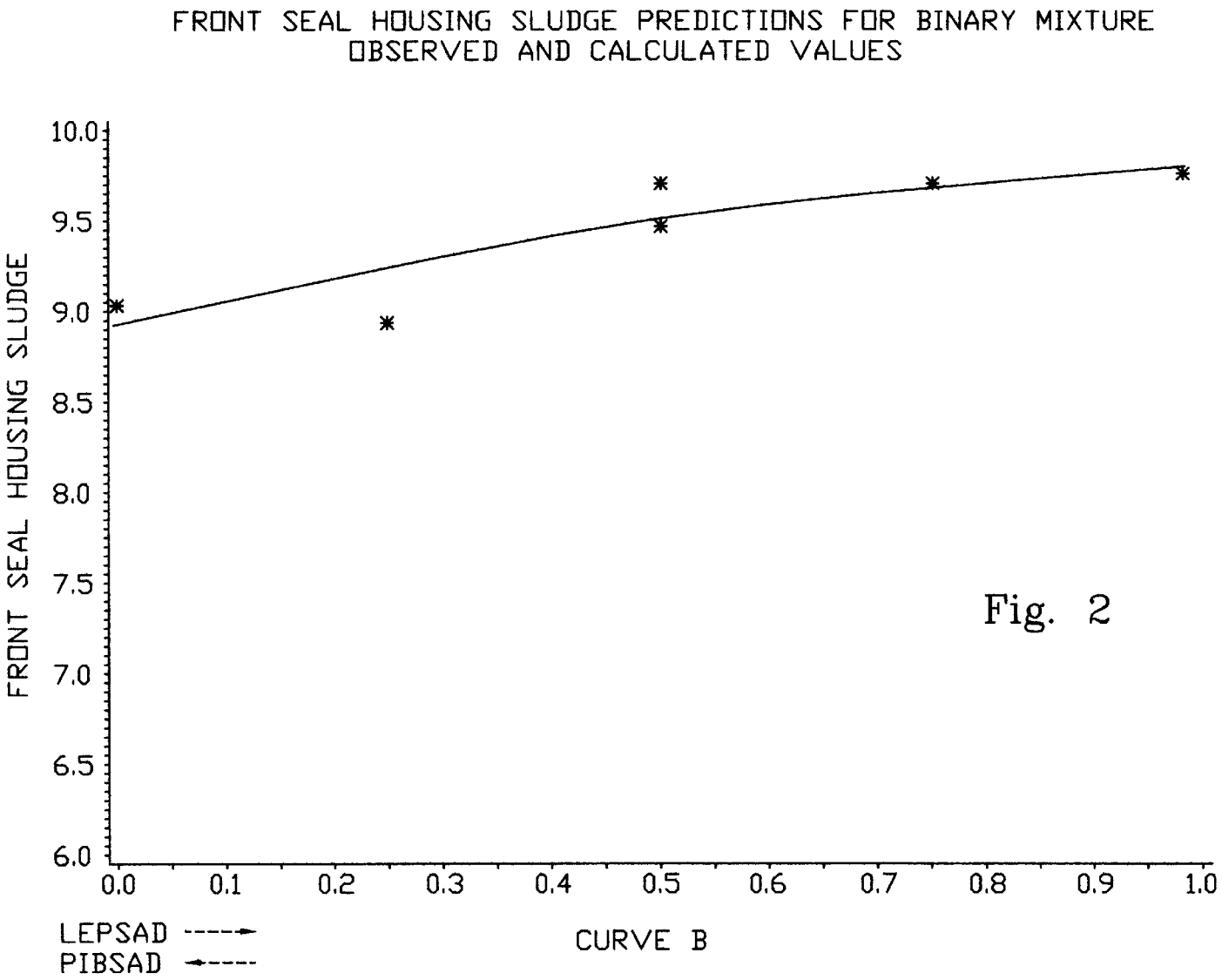
FIG. 2 is a graft of Front Seal Housing Sludge predictions for Binary Mixture observed and calculated values.
Figure 3:
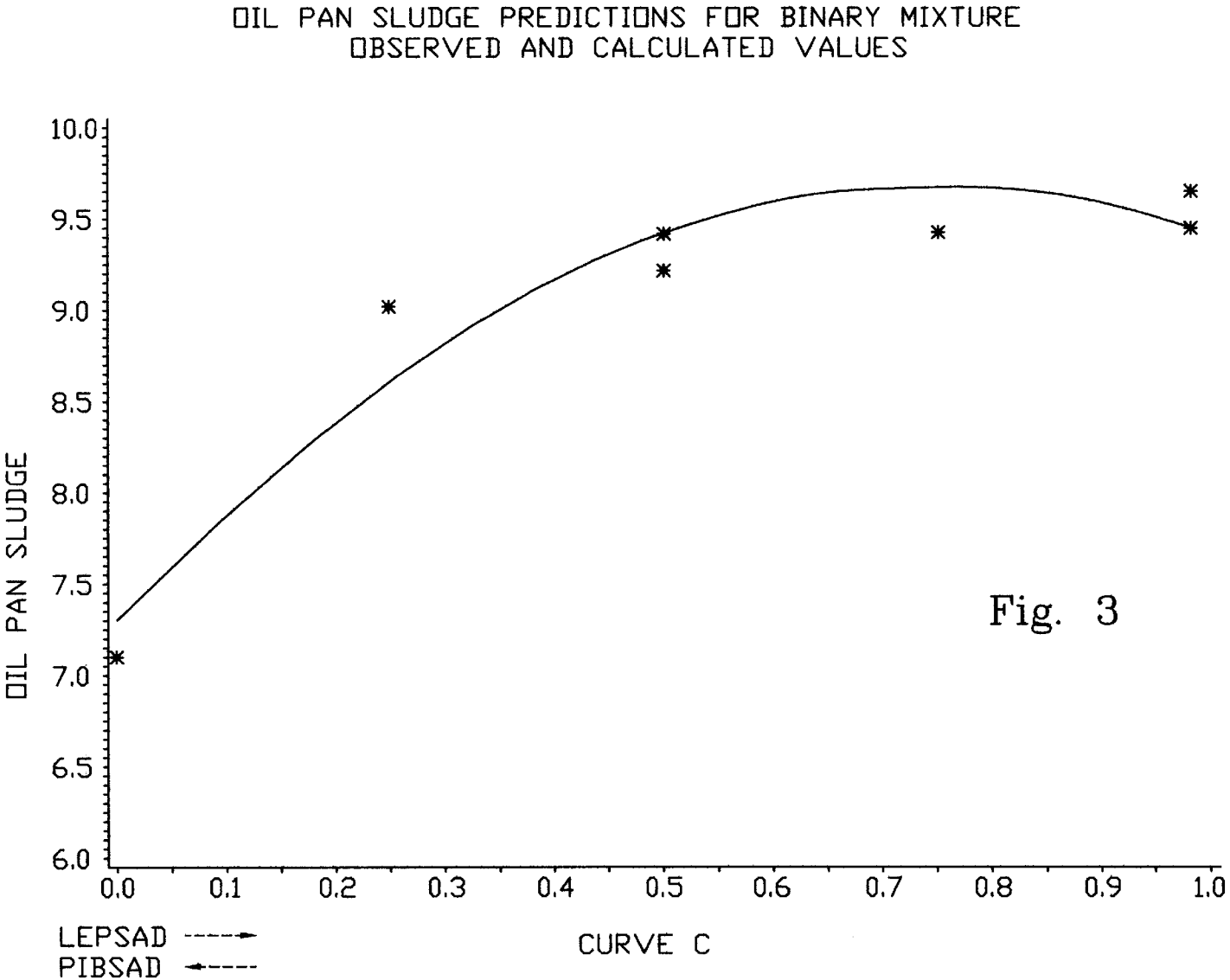
FIG. 3 is a graph of Oil Pan Sludge predictions for Binary Mixture observed and calculated values.
Figure 4:
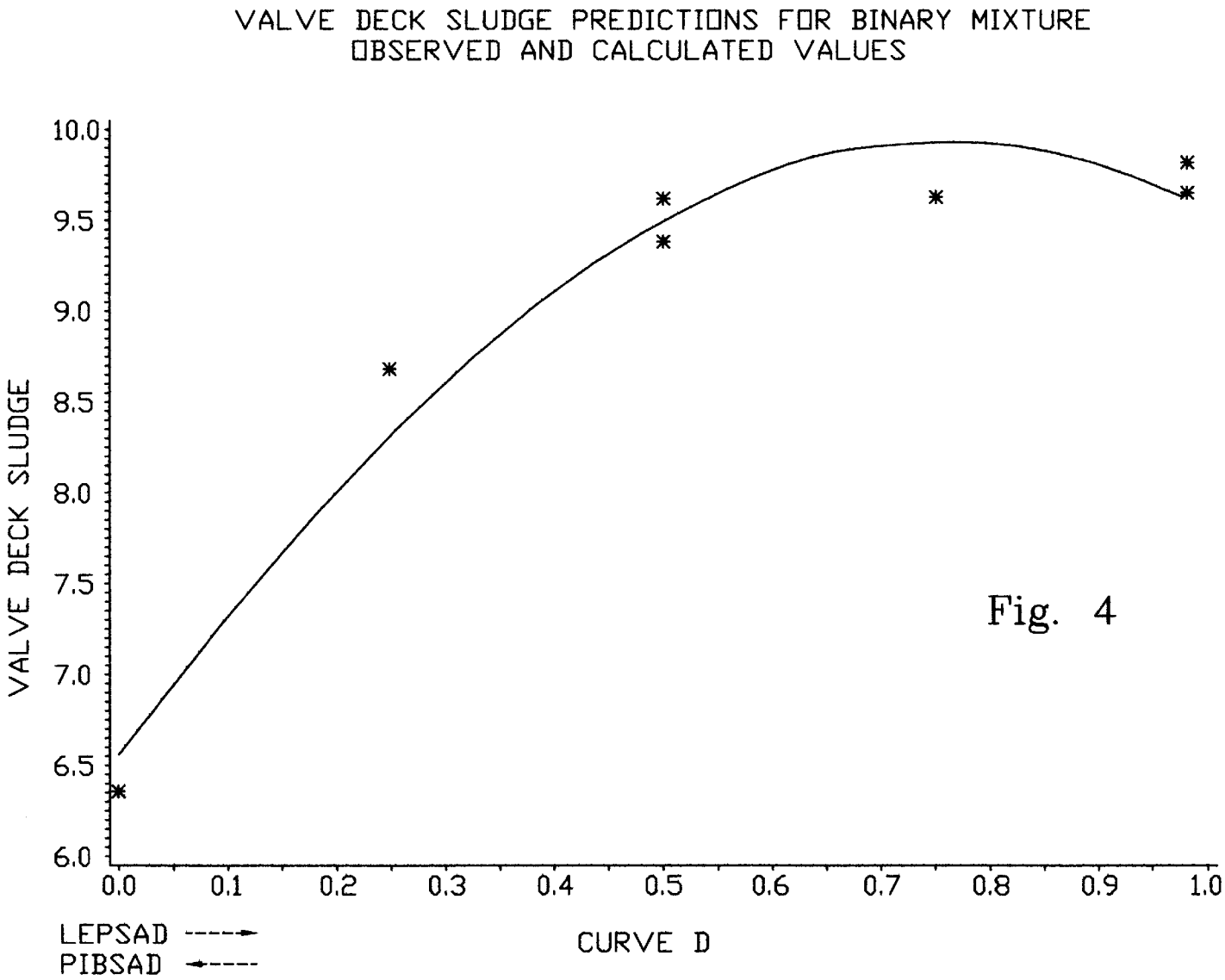
FIG. 4 is a graph of Valve Deck Sludge predictions for Binary Mixture observed and calculated values.
Figure 5:
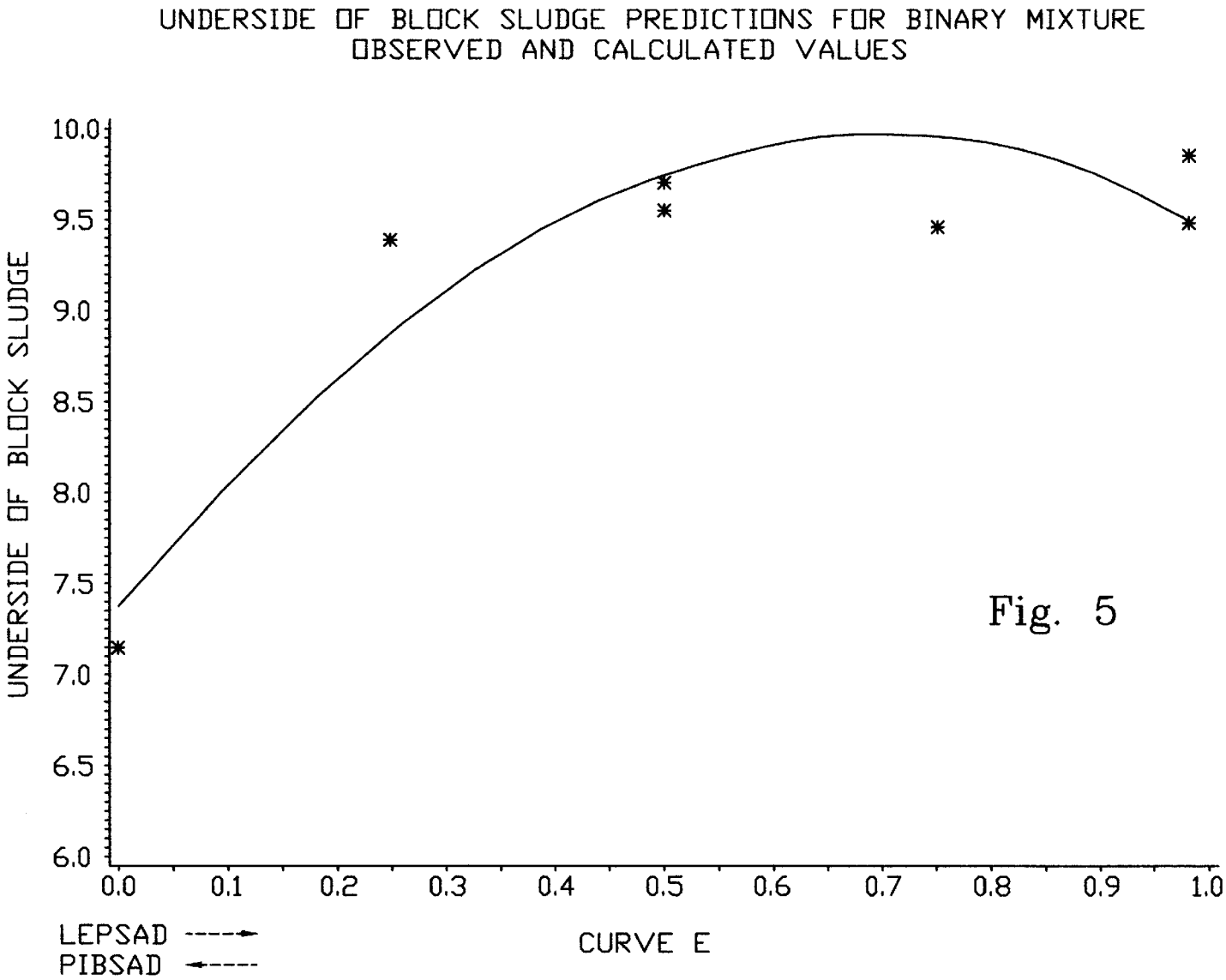
FIG. 5 is a graph of Underside of Block Sludge predictions for Binary Mixture observed and calculated values.
Figure 6:
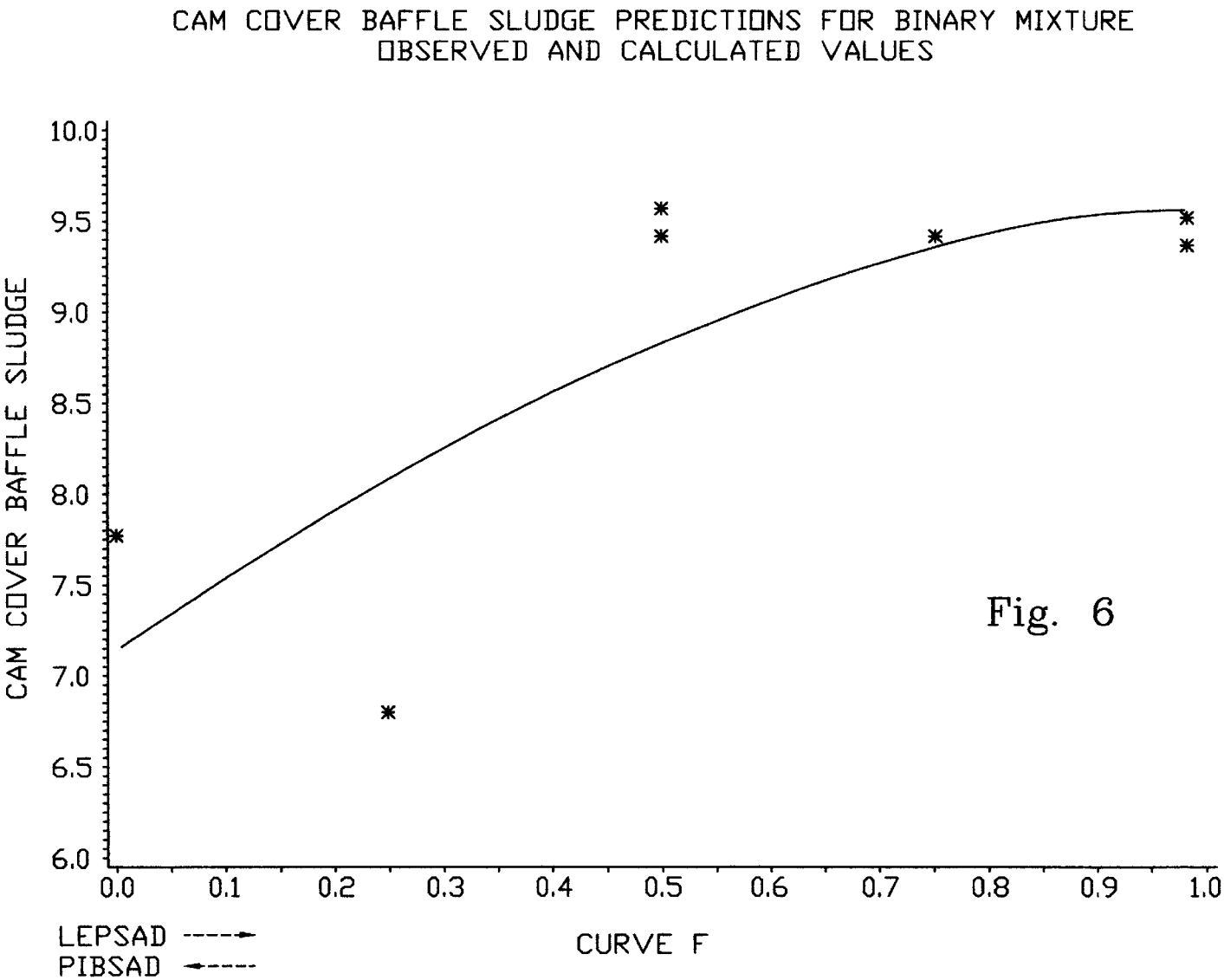
FIG. 6 is a graph of Cam Cover Baffle Sludge predictions for Binary Mixture observed and calculated values.
Figure 7:
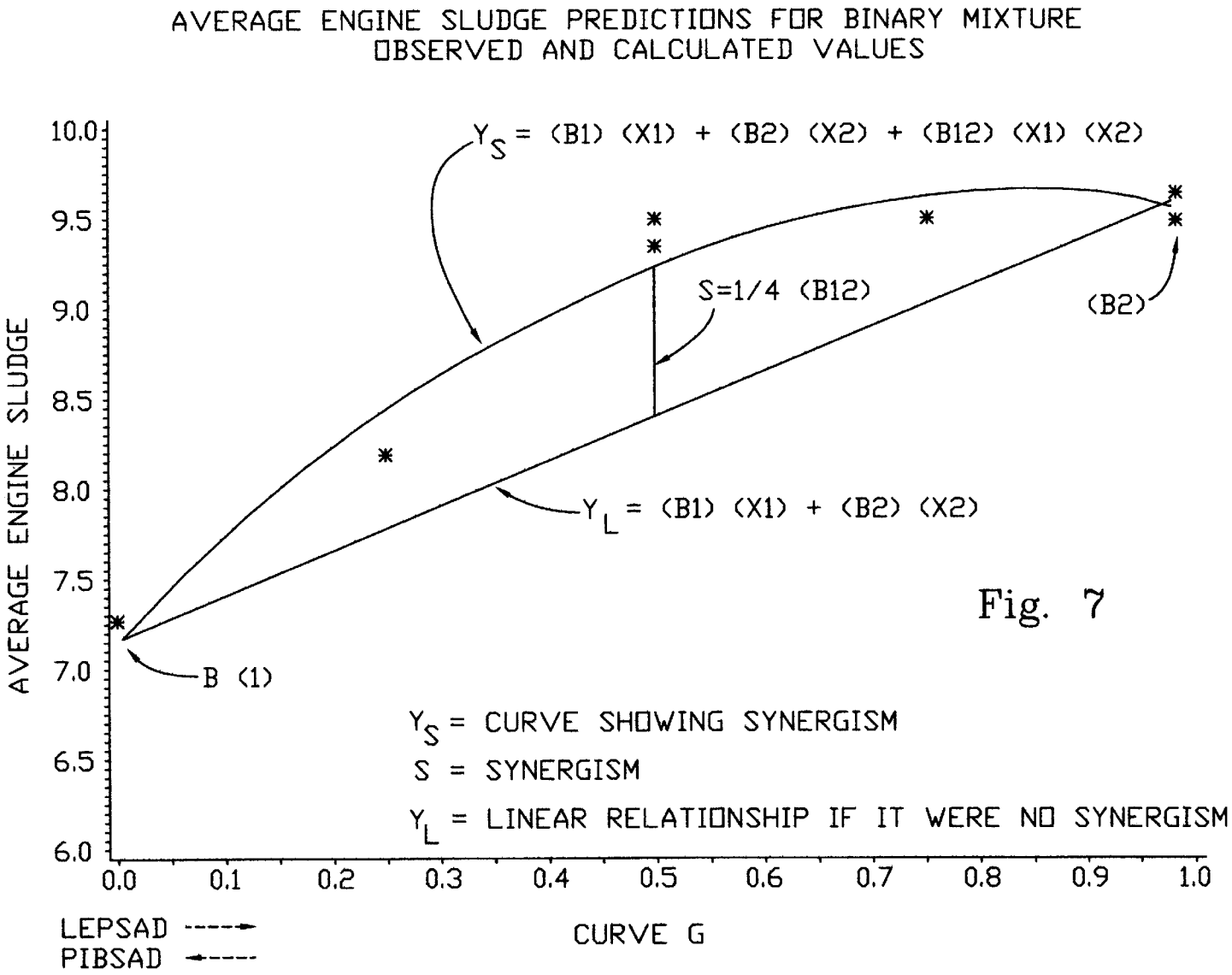
FIG. 7 is a graph of Average Engine Sludge predictions for Binary Mixture observed and calculated values.

The lubricating oil composition of the present invention, comprises:

(a) a major amount of an oil of lubricating viscosity; and (b) a minor amount of a synergistic combination of antioxidant-dispersant additive and a dispersant additive, said combination comprising:

(i) a polyisobutylene succinimide (PIBSAD) represented by the formula:

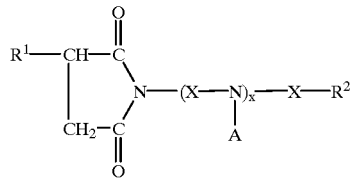

in which $R^1$ is a hydrocarbyl radical having from about 8 to 800 carbon atoms, X is a divalent alkylene or secondary hydroxy substituted alkylene radical having from 2 to 3 carbon atoms, A is hydrogen or a hydroxyacyl radical selected from the group consisting of glycolyl, lactyl, 2-hydroxy-methyl propionyl and 2,2'bishydroxymethyl propionyl radicals and in which at least 30 percent of said radicals represented by A are said hydroxyacyl radicals, x is a number from 1 to 6, and $R^2$ is a radical selected from the group consisting of —$NH_2$—NHA or a hydroxcarbyl substituted succinyl radical having the formula

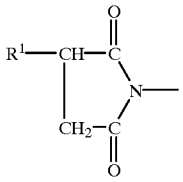

in which $R^1$ is as defined above; and (ii) an ethylene-propylene succinimide (LEPSAD) composition prepared by the steps comprising:

(A) reacting a polymer prepared from ethylene and at least one $C_3$ to $C_{10}$ alpha-monoolefin and, optionally, a polyene selected from non-conjugated dienes and trienes comprising from about 15 to 80 mole percent of ethylene from about 20 to 85 mole percent of said $C_3$ to $C_{10}$ alpha-monoolefin and from about 0 to 15 mole percent of said polyene, said polymer having a number average molecular weight ranging above 80,000, with an excess in equivalence of an olefinic carboxylic acid acylating agent per equivalent weight of said polymer, said process comprising heating said polymer to a molten condition at a temperature in the range of 250° C. to 450° C. and, simultaneously, or sequentially in any order, reducing the molecular weight of said polymer with mechanical shearing means and grafting said olef inic carboxylic acylating agent onto said polymer, thereby producing a grafted, reduced molecular weight polymer having a number average molecular weight ranging from 5,500 to 50,000 and having at least 1.8 molecules of said carboxylic acid acylating function grafted onto each copolymer molecule of said reduced polymer, and (B) reacting said grafted reduced polymer in (A) with an amino-aromatic polyamine compound selected from the group consisting of:

(a) an N-arylphenylenediamine represented by the formula:

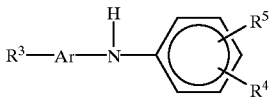

in which Ar is an aromatic hydrocarbon radical; $R^3$ is hydrogen, —NH-aryl, NH-arylalkyl or a branched or straight chain radical having from 4 to 24 carbon atoms that can be alkyl, alkenyl, alkoxyl, aralkyl alkaryl, hydroxyalkyl or aminoalkyl; $R^4$ is $—NH_2$, $—[NH(CH_2)_n—]_m—NH_2$, $—CH_2—(CH_2)_n—NH_2$, $—CH_2$-aryl-$NH_2$ in which n and m each have a value of from 1 to 10; and $R^5$ is hydrogen, or having from 4 to 24 carbon atoms that can be alkyl, alkenyl, alkoxyl, aralkyl alkaryl, hydroxyalkyl or aminoalkyl; $R^4$ is $—NH_2$, $—[NH(CH_2)_n—]_m—NH_2$, $—CH_2—(CH_2)_n—NH_2$, $—CH_2$-aryl-$NH_2$ in which n and m each have a value of from 1 to 10; and $R^5$ is hydrogen, or an alkyl, alkenyl, alkoxyl, arylalkyl, or alkylaryl radical having 4 to 24 carbon atoms;

(b) an aminocarbazole represented by the formula:

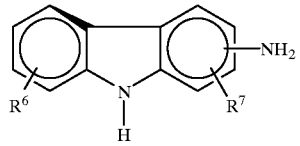

in which $R^6$ and $R^7$ each are hydrogen or an alkyl or alkenyl radical having from 1 to 14 carbon atoms;

(c) an aminoindole represented by the formula:

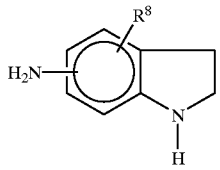

(d) an amino-indazolinone represented by the formula:

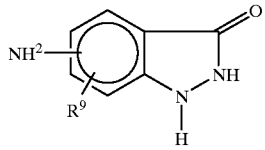

in which R is hydrogen or an alkyl radical having from 1 to 14 carbon atoms;

(e) an aminomercaptotriazole represented by the formula:

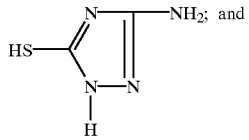

(f) an aminoperimidine represented by the formula:

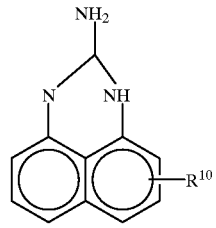

in which $R^{10}$ is hydrogen or an alkyl, alkenyl or alkoxyl radical having from 1 to 8 carbon atoms.

According to the present invention an alternate embodiment of the a polyisobutylene succinimide (PIBSAD) may be used instead of the embodiment described above. This alternate embodiment is represented by the formula

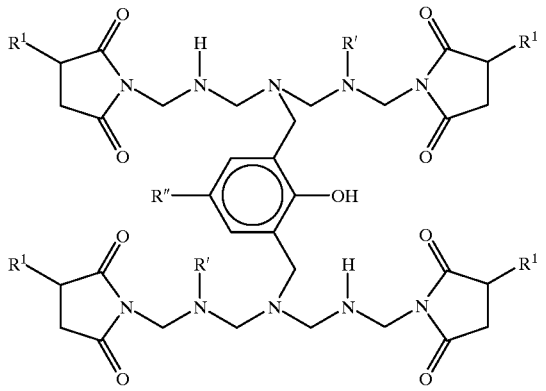

where $R^1$ is a hydrocarbyl radical having from 8 to 800 carbon atoms and has a number average molecular weight ranging from about 500 to about 10,000. Preferably $R^1$ is a polyisobutylene residue and has a number average molecular weight ranging from about 500 to about 3,000.

This alternate polyisobutylene may be prepared by the process which comprises:

(a) reacting an amine with an alkenyl succinic acid anhydride to form a mono- and/or bis-alkenyl succinimide;

(b) adding a phenol and an excess of formaldehyde to said mono and/or bis-alkenyl succinimide to form a Mannich phenol coupled mono-and/or bis-alkenyl succinimide;

(c) acylating said Mannich phenol coupled mono- and/or bis-alkenyl succinimide with an acylating agent, thereby forming a Mannich phenol coupled acylated mono-and/or bis-alkenyl succinimide; and (d) recovering said Mannich phenol coupled acylated mono- and/or bis-alkenyl succinimide.

The lubricating oil composition of this invention, basically, contains two different dispersants. These dispersants are low molecular weight ethylene-propylene succinimides (LEPSAD) described in U.S. Pat. No. 5,075,383 and polyisobutylene succinimides (PIBSAD) dispersants described in U.S. Pat. Nos. 4,482,464; 4,636,322; 4,699,724 and 4,713,489. Together, as shown below, they exhibit an unexpected improvement in ASTMS Sequence VE gasoline engine test sludge ratings than either component can provide separately. This unexpected improvement in Sequence VE sludge rating is a unique and useful example of synergism between different dispersant components in a lubricating oil formulation.

The synergism, as illustrated below, was confirmed utilizing a simplex statistical model. The model showed that in the ASTMS Sequence VE gasoline engine test, LEPSAD gives superior sludge and varnish as compared to PIBSAD as evidenced in U.S. Pat. No. 5,075,383. More importantly, there is a synergism in Sequence VE sludge performance when the two dispersants are mixed. This allows one to significantly reduce the dispersant treating dosage in a give formulation. Reducing the amount of PIBSAD in a formula allows one to prepare a fully formulated motor oil with less light base oil. Thus the more expensive and environmentally undesirable (due to volatility) light base oils can be replaced with heavier base oils and the appropriate viscosity grades achieved.

The LEPSAD dispersant of this invention comprises an ethylene copolymer or terpolymer of a $C_3$ to $C_{10}$ alpha-monoolefin and optionally a non-conjugated diene or triene having a number average molecular weight (Mn) ranging from about 5,500 to 50,000 (6,000 to 10,000 preferred) on which, at some stage of one of the processes, has been grafted at least 1.8 molecules per copolymer molecule of an ethylenically unsaturated carboxylic function which is then further derivatized with an amino-aromatic polyamine compound such as N-arylphenylenediamine represented by the formula:

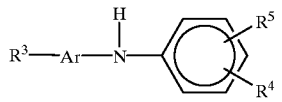

in which Ar is an aromatic hydrocarbon radical; $R^3$ is hydrogen, —NH-aryl, NH-arylalkyl, a branched or straight chain radical having from 4 to 24 carbon atoms that can be alkyl, alkenyl, alkoxyl, aralkyl alkaryl, hydroxyalkyl or aminoalkyl; $R^4$ is $—NH_2$, $—[NH(CH_2)_n—]_m—NH_2$, $—CH_2—(CH_2)_n—NH_2$, $—CH_2$-aryl-$NH_2$ in which n and m each have a value of from 1 to 10; and $R^5$ is hydrogen or an alkyl, alkenyl, alkoxyl, aralkyl or alkaryl radical having 4 to 24 carbon atoms.

The ethylenically unsaturated carboxylic function can be a dicarboxylic acid, anhydride or ester thereof, such as fumaric acid, itaconic acid, maleic acid, maleic anhydride, chloromaleic acid, dimethylfunarte, chloromaleic anhydride, and mixtures thereof.

The above antioxidant moiety can be mixed in all proportions with other polyamines on the polymer backbone and produce a useful product. The polyamines which can be used in mixtures with N-arylphenylenediamine contain only one primary amine, no secondary amines unless highly hindered, and all the rest are tertiary amines. Examples of such amines are listed below in Table I.

The mechanical shearing may be done to the starting ethylene-propylene copolymer rubber and then grafted with an ethylenically unsaturated carboxylic function (ie. maleic anhydride) and then further derivatized with an amino-aromatic polyamine (ie. N-arylphenylenediamine). Alternatively, shearing may be done to the pre-derivatized rubber followed by treatment with an amino-aromatic polyamine. In the case where an extruder is used the ethylene-propylene copolymer rubber may be grafted with an ethylenically unsaturated carboxylic function while simultaneously being sheared.

The polyisobutenyl succinimide dispersant (PIBSAD) that contributes to the synergistic effect comprises a reaction product that may generally be prepared by the following process which comprises:

(a) reacting a polyethylene amine with an alkenyl succinic acid anhydride to form a mono- and/or bis-alkenyl succinimide;

(b) reacting the mono- and/or bis-alkenyl succinimide with an acylating compound, thereby forming an acylated mono- and/or bis-alkenyl succinimide; and (c) recovering the acylated mono- and/or bis-alkenyl succinimide.

In carrying out the process of this invention, the reagents are step wise reacted with a long chain hydrocarbyl substituted dicarboxylic acid anhydride containing residual unsaturation in a "one pot reaction". The long chain hydrocarbon group is a ($C_2$–$C_{10}$) polymer, e.g., a ($C_2$–$C_5$) monoolefin, the polymer having a number average molecular weight (Mn) of about 500 to about 10,000.

The preferred olefin polymers for reaction with the unsaturated dicarboxylic acid anhydride or ester are polymers comprising a major molar amount of ($C_2$–$C_{10}$) polymer, e.g., a ($C_2$–$C_5$) monoolefin. Such olefins include ethylene, propylene, butylene, isobutylene, pentene, 1-octene, styrene, etc. The polymers can be homopolymers such as polyisobutylene, as well as copolymers of two or more of such olefins such as copolymers of: ethylene and propylene, butylene and isobutylene, propylene and isobutylene, etc. Other copolymers include those in which a minor molar amount of the copolymer monomers e.g., 1 to 10 mole % is a ($C_4$–$C_{10}$) non-conjugated diolefin, e.g., a copolymer of isobutylene and butadiene; or a copolymer of ethylene, propylene and 1,4-hexadiene; etc.

The long chain hydrocarbyl substituted dicarboxylic acid producing material, e.g. acid or anhydride used in the invention includes a long chain hydrocarbon, generally a polyolefin, substituted typically with an average of at least about 0.8 per mole of polyolefin, of an alpha- or beta-unsaturated ($C_4$–$C_{10}$) dicarboxylic acid, anhydride or ester thereof, such as fumaric acid, itaconic acid, maleic acid, maleic anhydride, chloromaleic acid, dimethylfumarte, chloromaleic anhydride, and mixtures thereof.

The alkenyl succinic acid anhydride may be characterized by the following formula

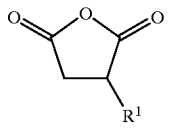

where $R^1$ may be a residue (containing residual unsaturation) from a polyolefin which was reacted with maleic acid anhydride to for the alkenyl succinic acid anhydride. $R^1$ may have a number average molecular weight (Mn) ranging from about 500 to about 10,000, preferably from about 1000 to about 5000, and more preferably from about 2000 to about 2500.

The polyamine compositions which may be employed in practicing the present invention for either PIBSAD or LEPSAD may include primary and/or secondary amines. The amines may typically be characterized by the formula

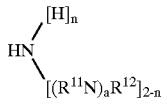

where a may be an integer of about 3 to about 8, preferably about 5; and n may be an integer of 0 or 1. In the above compound, $R^{12}$ may be hydrogen or a hydrocarbon group selected from the group consisting of alkyl, arylalkyl, cycloalkyl, aryl, alkylaryl, alkenyl, and alkynyl, including such radicals when inertly substituted. The preferred $R^{12}$ groups may be hydrogen or lower alkyl group, i.e., ($C_1$–$C_{10}$) alkyl groups including, e.g., methyl, ethyl, n-propyl, i-propyl, butyls, amyls, hexyls, octyls, decyls, etc. $R^{12}$ may preferably be hydrogen. $R^{11}$ may be a hydrocarbon selected from the same group as $R^{12}$ subject to the fact that $R^{11}$ is divalent and contains one less hydrogen. Preferably $R^{12}$ is hydrogen and $R^{11}$ is —$CH_2CH_2$—. Examples of such amines are listed below in Table II:

TABLE II diethylenetriamine (DETA)
triethylenetetramine (TETA)
tetraethylenepentamine (TEPA)
pentaethylenehexamine (PEHA)

The above-mentioned amines, may be treated with acylating agents which may be selected from the group consisting of a hydroxyaliphatic acid that contains from 1 to 4 carbon atoms exclusive of the carbonyl group. The preferred hydroxyaliphatic acid is glycolic acid.

Alternatively, the secondary amine groups of the polyalkenylamine moiety in the coupled mono- and/or bis-alkenyl succinimide are reacted with a borating agent selected from the group consisting of boric acid, boron oxide, boron halide, and a boron acid ester, to provide a borated derivative thereof.

Or, the secondary amine groups of the polyalkenylamine moiety in said coupled mono- and/or bis-alkenyl succinimide are reacted with an aldehyde and phenolic compound in a Mannich reaction, this coupling reaction may then be followed by either acylation or boration steps.

The aldehyde which may be employed may include those preferably which characterized by the formula $R^{13}CHO$. In the preceding compound, $R^{13}$ may be hydrogen or a hydrocarbon group consisting of alkyl, arylalkyl, cycloalkyl, aryl, alkylaryl, alkenyl, and alkynyl including such radicals when inertly substituted. When $R^{13}$ is alkyl, it may typically be methyl, ethyl, n-propyl, isopropyl, n-butyl, isobutyl, secbutyl, amyl, octyl, decyl, dodecyl, octadecyl, etc. When $R^{13}$ is arylalkyl, it may typically be benzyl, beta-phenylethyl, etc. When $R^{13}$ is cycloalkyl, it may typically be cyclohexyl, cycloheptyl, cyclooctyl, 2-methylcycloheptyl, 3-butylcyclohexyl, 3-methylcyclohexyl, etc. When $R^{13}$ is alkylaryl, it may typically be tolyl, xylyl, etc. When $R^{13}$ is alkylnyl, it may typically be ethynyl, propynyl, butynyl, etc. When $R^{13}$ is aryl, it may typically be phenyl, naphthyl, etc. When $R^{13}$ is alkenyl, it may typically be vinyl, allyl, 1-butenyl, etc. $R^{13}$ may be inertly substituted i.e. it may bear a non-reactive substituent such as alkyl, aryl, cycloalkyl, ether, halogen, nitro, etc. Typically inertly substituted R groups may include 3-chloropropyl, 2-ethoxyethyl, carboethoxymethyl, 4-methyl cyclohexyl, p-chlorophenyl, p-chlorobenzyl, 3-chloro-5-methylphenyl, etc. The preferred $R^{13}$ groups may be lower alkyl, [i.e.,($C_1$–$C_{10}$) alkyl] groups including methyl, ethyl, n-propyl, isopropyl, butyls, amyls, hexyls, octyls, decyls, etc. $R^{13}$ may preferably be hydrogen.

Typical aldehydes which may be employed may include those listed below in Table III:

TABLE III formaldehyde
ethanal
propanal
butanal

The phenols which may be employed in the process of this invention may preferably be characterized by the formula $HR^{14}OH$. It is a feature of these phenols that they contain an active hydrogen which will be a site for substitution. Polyphenols (eg compounds containing more than one hydroxy group in the molecule whether on the same ring or not) may be employed. The rings on which the hydroxy groups are situated may bear inert substituents. However, at least two positions e.g. ortho- and para-, to a phenol hydroxy group, must be occupied by an active hydrogen as this is the point of reaction with the iminium salt group. $R^{14}$ may be an arylene group typified by —$C_6H_4$—, —$C_6H_3(CH_3)$— or —$C_6H_3(C_2H_5)$—. The preferred phenols may be phenol, mono-nonylphenol, or 4-hydroxydiphenylamine.

Typical phenols which may be employed may include those listed below in Table IV.

TABLE IV

Phenol
Bisphenol A
Resorcinol
Mono-nonylphenol
Beta-naphthol
4-hydroxydiphenylamine The lubricating oil of the invention will contain the novel reaction products each in a concentration ranging from about 0.1 to 30 weight percent. A concentration range for each additive ranging from about 0.5 to 15 weight percent based on the total weight of the oil composition is preferred with a still more preferred concentration ranges being from about 1 to 8.0 weight percent.

Oil concentrates of the additives may contain from about 1 to 75 weight percent of the additive reaction products in a carrier or diluent oil of lubricating oil viscosity.

The novel reaction product of the invention may be employed in lubricant compositions together with conventional lubricant additives. Such additives may include additional dispersants, detergents, antioxidants, pour point depressants, anti-wear agents and the like.

The novel additive reaction products of the invention were tested for their effectiveness as a synergistic dispersant combination in a fully formulated lubricating oil composition.

The advantages of the above described process and products will be more apparent by the Examples provided below.

EXAMPLE 1

Preparation of Dispersant-Antioxidant from Ethylene-Propylene Copolymer Solution Grafted with about 3.8 Molecules Maleic Anhydride Per Copolymer Molecule A 62.5 weight percent mixture of ethylene-propylene copolymer grafted with 2.5 weight percent maleic anhydride in oil (1431.5 g) was charged into a 3000 mL 4-neck kettle along with 100 P Pale oil (982.4 g). The kettle was equipped with a mechanical stirrer, thermometer, thermocouple, and nitrogen inlet and heated to 160° C. Next N-phenyl-p-phenylenediamine (45.9 g, 0.249 moles) was added along with Surfonic N-40 (71.5 g). The reaction temperature was maintained at 160° C. for 6 hours. The product (an approximately 37% concentrate) analyzed as follows: % N=0.41 (0.28 calc.), Kinematic Viscosity (100 C)=3590 cSt.

EXAMPLE 2

The Mechanical/Thermal Shearing Preparation of Dispersant-Antioxidant from Ethylene-Propylene Copolymer The ethylene-propylene copolymer (about 100,000 Mn) was chopped and processed through an extruder in a molten state at a temperature near 400° C., just prior to entering the extruder screw maleic anhydride and dicumyl peroxide were mixed with the molten polymer and the polymer exiting from the die face of the extruder was mixed with SNO 100 oil. Analysis by titration of rubber isolated from the oil found it to be grafted with 2.1% maleic anhydride. The ethylene-propylene copolymer grafted with 2.1 weight percent maleic anhydride (1543.1 g) was dissolved in SNO 100 oil (468.9 g) in a 3000 mL 4-neck kettle at 160° C. The kettle was equipped with a mechanical stirrer, thermometer, thermocouple, and nitrogen inlet. Next N-phenyl-p-phenylenediamine (29.3 g, 0.159 moles) was added along with Surfonic L46-7 (60 g). The reaction temperature was maintained at 160° C. for 6 hours. The product (an approximately 37% concentrate) analyzed as follows: % N=0.22 (0.21 calc.), Kinematic Viscosity (100 C)=913.8 cSt.

EXAMPLE 3

The Synthesis of Dispersant-Antioxidant from Ethylene-Propylene Copolymer Solution Grafted with 3.8 Molecules of Maleic Anhydride Per Copolymer Molecule Using a Mixture of Amines A 62.5 weight percent mixture of ethylene-propylene copolymer grafted with 2.5 weight percent maleic anhydride in oil (1200 g) was charged into a 4000 mL 4-neck kettle along with 100 P Pale oil (1200 g). The kettle was equipped with a mechanical stirrer, thermometer, thermocouple, and nitrogen inlet and heated to 160° C. Next N-phenyl-p-phenylenediamine (17.3 g, 0.094 moles) and N,N-dimethylaminopropylamine (9.6 g, 0.094 moles) was added along with Surfonic N-40 (60 g). The reaction temperature was maintained at 160° C. for 6 hours. The product (an approximately 31% concentrate) analyzed as follows: % N=0.31 (0.42 calc.) and Kinematic Viscosity (100 C)=1382 cSt.

EXAMPLE 4

Preparation of Acylated Mono- and/or Bis-Alkenyl Succinimide Dispersant

Polyisobutenylsuccinic acid anhydride (1161.1 g/min. 0.262 moles/min., PIBSA prepared from an approximately 2300 mol. wt. polybutene), 100 P pale oil (520.4 g/min.), and pentaethylenehexamine (38.2 g/min., 0.14 moles/min.) was added into an imidization reactor over a two hour period. The reaction was kept under nitrogen and maintained at 107° C. Next the imidization product was charged into an acylation reactor (1703.2 g/min) with 70% solution of glycolic acid (58.4 g/min.) over two hours. Then heat was maintained at 168° C. and maintained during the addition and then held an additional two hours. The product (an approximately 40% concentrate) analyzed as follows: % N=0.73% (0.70 calc.), kinematic Viscosity (100 C)=476 Cst.

EXAMPLE 5

Preparation of Acylated Mannich Phenol Coupled Mono- and/or Bis-Alkenyl Succinimide Dispersant A solution of polyisobutenylsuccinic acid anhydride (3965.0 g, 1.0 moles, PIBSA prepared from an approximately 2060 mol. wt. polybutene) in 100 P Pale oil (2237.0 g) was charged into an imidazation rector for 2.0 hours. Then nonylphenol (59.4 g, 0.27 moles) was added, followed by a 37% solution of formaldehyde (87.6 g, 1.08 moles). The temperature was maintained at 120° C. for 0.5 hours. Next a 70% solution of glycolic acid (159.8 g, 1.48 moles) was added and the temperature was raised to 160° C. and then maintained for 4 hours to drive off water. The hot mixture (100° C.) was filtered through diatomaceous earth filter aid. The product (an approximately 40% concentrate) analyzed as follows: % N=0.83 (0.71 calc.) and Kinematic Viscosity (100° C.)=366 Cst.

In order to show and confirm the synergism developed by the present invention, the follow results are provided.

Sequence VE Gasoline Engine Test Results: Simplex Statistical Model

The synergism was discovered using a simplex statistical model. This model can be used to save developmental costs. The method allows us to use a few tests to develop a predictive model. This model can then be used to predict the performance of the formulations over a range of dispersant combinations.

Experimental Design and the Formulations

To develop this predictive model that resulted in our discovery, experiments were designed, data collected, and then parameters of the model had to be estimated. Simplex design was used in this study as it is suited to formulation experimentation. In a formulation, components or variables are fractions of a mixture. Thus, they are nonnegative, expressed as a positive fraction and sum to a constant. In our work, PIBSAD and LEPSAD sum to 6 wt % (the dispersant dosage) and the remaining 94 wt % was a constant base blend. We considered only the binary mixtures of the two additives that together represent 100% of the dispersant dosage in the formulation. Our simplex (the region of experimentation) is the line X1+X2=1 where X1 is the fraction of PIBSAD and X2 the fraction of LEPSAD in the mixture. The simplest possible model of a response is a linear model over the region of interest. The best possible design for such a model would be to make a single Sequence VE run at each of the two points, (X1=1, X2=0) and (X1=0, X2=1). These are the vertices (extremes) of the binary mixture. However, such an experimental design is limited in that there is no measure of experimental variation (error) and the assumption of "linear over the region" cannot be verified. Therefore, additional runs were needed to estimate synergism or antagonism (nonlinear effects) and provide a measure of random error. Finally, check runs were also made to validate the model.

The compositions of the formulations for the present designed experiment are provided below in Table V. A single run at (X1=1, X2=0), Formulation I, two runs in the center of the region at (X1=0.5, X2=0.5), Formulation III, and two runs at (X1=0, X2=1), Formulation V, were made for developing the simplex model, estimating the non-linear effect and measuring random error. Formulations II, (X1=0.75, X2=0.25) and Formulation IV, (X1=0.25, X2=0.75) were the check runs to validate the model.

For the experiments, a base blend was first made. It consists all components and base oils for a fully formulated motor oil except dispersants. The test formulations I to V were than prepared by adding a constant 6 wt % of mixed dispersants, with the ratio of PIBSAD to LEPSAD at 100/0, 75/25, 50/50, 25/75, and 0/100, respectively. Each formulation contains approximately 0.37 wt % calcium, 0.11 wt % phosphorous, 1.00 wt % sulfur, and 0.12 wt % zinc. Except the check runs, the tests were run at a random sequence, on the same Sequence VE engine stand and the results were rated by the same technician.

Sequence VE Sludge Predictive Models

The ASTM Sequence VE gasoline engine test is used to evaluate the performance of gasoline engine oils in protecting engine parts from sludge and varnish deposits and valve train wear due to low temperature "stop and go" operation. The test uses a Ford 2.3 L four-cylinder Ranger truck engine. The engine is cycled through three test stages, requiring four hours to complete, for 288 hours or 72 cycles.

In the Sequence VE test, six individual areas are rated for sludge and five areas are rated for varnish. In addition, there is an overall average sludge and an overall average rating for varnish. These ratings are based upon a 0 to 10 scale with 10 being the cleanest possible rating. Each of the individual and overall average ratings were analyzed by fitting a Sheffe polynomial to the data. The results for the sludge ratings are contained below in Table VI and Table VIII and the analyses of these data and the evidence for synergism are discussed below.

A Sheffe quadratic polynomial in two variables model is $$Y=(B1)(X1)+(B12)(X1)(X2)+(B2)(X2)$$

where $0 \leqq X1 \leqq 1$, $0 \leqq X2 \leqq 1$ and $X1+X2=1$.

The above Sheffe model can be derived from the full quadratic model in two variables $$Y=(A0)+(A1)(X1)+(A2)(X1)^2+(A3)(X2)+(A4)(X2)^2+(A5)(X1)(X2)$$

by applying the constraints $$X1+X2=1$$

$$(X1)^2=(X1)(1-X2)=X1-(X1)(X2)$$

$$(X2)^2=(X2)(1-X1)=X2-(X1)(X2)$$

so that $$B1=A0+A1+A2$$

$$B2=A0+A3+A4$$

$$B12=A5-A2-A4$$

The full quadratic model provides accurate predictions over reasonable ranges of the independent variables. With the added constraints on X1 and X2, the three term Sheffe model is equal to the full quadratic polynomial. The Sheffe polynomial is the mixture model commonly used to estimate any synergism or antagonism since these effects can be deduced directly from the sign and magnitude of the coefficient B12; synergism if B12>0 and antagonism if B12<0. In addition, the magnitude of B12 should be statistically significantly different from zero. This significance of each term in the model will be tested with the random error estimate based upon the two repeat runs.

For the sludge data, the coefficients of the Sheffe polynomial were determined by least squares for each of the VE rating areas: Rocker Arm Cover, Front Seal Housing, Oil Pan, Valve Deck, Underside of Block, the Can Cover Baffle and the overall Average Engine rating. In all cases the model fit the data well as evidenced by the small random error estimates in Table VII. Also, every rating area (except the Front Seal Housing) and in particular the overall Average Engine sludge rating shows statistically significant linear effects of PIBSAD and more importantly a significant interaction term (B12). This is evidenced by the probabilities (Prob>|T|) of observing a B12 as large as the estimate are all less than 0.05. In fact, many are listed as 0.0001 which means the probability is about 1 in 10,000 that the estimated interaction is due to chance since the sign of the interaction is positive, it indicates a significant synergistic effect of the two additives PIBSAD and LEPSAD. Additional Student's t test indicate that (except for the Front Seal Housing data) the difference between B1 and B2 is also statistically significant. For the Sheffe polynomials, if the coefficients of the linear terms do not differ significantly then there is no effect over the experimental region since the same constraint X1+X2=1 implies that the response Y is constant over the simplex. Examination of the Front Seal Housing data shows all the sludge ratings are greater than 9.0 (extremely clean) and the equal effects of PIBSAD and LEPSAD.

Sludge Check Runs (Confirmation of Synergism)

For further confirmation of the present models, two additional check runs were made equidistant from the first five runs; i.e., at (X1=0.75, X2=0.25) and (X1=0.25, X2=0.75). These additional data are shown in Table VIII and the model coefficients and random error in Table IX. Here the random error includes not only the error among repeats runs but any lack of fit of the model. For the Rocker Arm Cover, Underside of Block and the Cam cover Baffle areas, the lack of fit as measured by the check runs is large and increases the error significantly. However, the synergism (B12) is still significant for all areas expect the Front Seal Housing and the Cam Cover Baffle and in all the actual the parameter estimates B1, B2 and B12 change only slightly. As discussed above the Front Seal Housing ratings are extremely high (clean) for all formulations and it is not surprising that the parameters are not significant.

The magnitude of the synergism of combining two variables bounded by 0 and 1 and that sum to 1.0 will be a maximum when both variables equal 0.5. The synergism is the interaction effect in the Sheffe model and the maximum magnitude can be estimated by multiplying the B12 in Table IX by 0.25. Further, each of the models in Table IX are shown in graphical form as Curves A through G and the synergism can be seen as the deviation from the line connecting the two points at 1.0 PIBSAD and 1.0 LEPSAD.

As demonstrated above the Sheffe quadratic polynomial in only three terms is equivalent to the full quadratic polynomial with two independent variables. Further, all of the nonlinear effects in the full quadratic are estimated as the interaction term in the Sheffe model. Synergistic and/or antagonistic effects are indicated by the sign and magnitude of the interaction coefficient. Using the Sequence VE data, the synergism of PIBSAD and LEPSAD is estimated with the Sheffe polynomial.

In the binary mixture problem the simplex is merely all possible concentrations (fractions) of the two the components and can be represented by a line between 0 and 1.0 including the end points.

Viscosity Index Improver Credit

The data in Table X, below, show that at constant dispersant treating dosage replacing PIBSAD with LEPSAD enhances thickening at elevated temperatures (Kinematic Viscosity @ 100° C.), in a single grade formulation. In a multigrade formula this allows one to reduce the Viscosity Index Improver needed to achieve the proper thickening. In Table XI the comparison of formulations VI and VII shows a 2.5% saving in Viscosity Index improver.

Light Base Oil Credit

The data in Table XI illustrates the reduction in light base oil (PAO). If one compares formulas VI to VII, then a 5% percent saving of light base oil is achieved. This is significant due to the higher cost of PAO compared to SNO-100 oil.

Further, below the predictions of the sludge factors (i.e., approximate percentage) are provided below in curves A, B, C, D, E, F and G.

The Curves A, B, C, etc., illustrate the sludge factor predications of various parts of the engine including the rocker arm, the front seal housing, oil pan, etc.

TABLE V

TEST FORMULATIONS FOR SIMPLEX DESIGN

| TEST FORMULATIONS | COMPOSITION (WT %) I | II | III | IV | V |
|---|---|---|---|---|---|
| PIBSAD (Example 4) | 6.00 | 4.50 | 3.00 | 1.50 | 0.00 |
| LEPSAD (Example 1) | 0.00 | 1.50 | 3.00 | 4.50 | 6.00 |
| BASE BLEND | 94.00 | 94.00 | 94.00 | 94.00 | 94.00 |

TABLE VI

SEQUENCE VE SLUDGE RATINGS ON TEST FORMULATIONS

| TEST FORMULATIONS | MERIT RATINGS I | II | III | IV | V |
|---|---|---|---|---|---|
| ROCKER ARM COVER (7.0 MIN) | 6.18 | 9.43 | 9.30 | 9.40 | 9.22 |
| FRONT SEAL HOUSING | 9.02 | 9.50 | 9.73 | 9.73 | 9.70 |
| OIL PAN | 7.14 | 9.22 | 9.40 | 9.54 | 9.42 |
| VALVE DECK | 6.42 | 9.40 | 9.63 | 9.60 | 9.7 |
| UNDERSIDE OF BLOCK | 7.15 | 9.55 | 9.62 | 9.67 | 9.45 |
| CAM COVER BAFFLE | 7.74 | 9.38 | 9.49 | 9.51 | 9.39 |
| AVERAGE ENGINE (9.0 MIN) | 7.28 | 9.41 | 9.53 | 9.58 | 9.48 |

TABLE VII

SIMPLEX MODEL OF SEQUENCE VE SLUDGE RATINGS (DERIVED FROM 5 TEST RUNS)

| RATING AREA | COEFFICIENTS AND T PROBABILITY B(1) | PROB > T | B(12) | PROB > T | B(2) | PROB > T | RANDOM ERROR |
|---|---|---|---|---|---|---|---|
| ROCKER ARM COVER | 6.18 | 0.0003 | 6.48 | 0.0041 | 9.31 | 0.0001 | 0.012 |
| FRONT SEAL HOUSING | 9.02 | 0.0002 | 0.99 | 0.1501 | 9.72 | 0.0001 | 0.013 |
| OIL PAN | 7.14 | 0.0002 | 4.00 | 0.0101 | 9.48 | 0.0001 | 0.011 |
| VALVE DECK | 6.42 | 0.0004 | 5.92 | 0.0062 | 9.65 | 0.0001 | 0.015 |
| UNDERSIDE OF BLOCK | 7.15 | 0.0003 | 4.92 | 0.0076 | 9.56 | 0.0001 | 0.013 |
| CAM COVER BAFFLE | 7.74 | 0.0001 | 3.36 | 0.0081 | 9.53 | 0.0001 | 0.006 |
| AVERAGE ENGINE | 7.28 | 0.0001 | 4.26 | 0.0047 | 9.53 | 0.0001 | 0.006 |

TABLE VIII

SEQUENCE VE SLUDGE RATINGS ON CHECK FORMULATIONS

| CHECK FORMULATIONS | MERIT RATINGS IV | MERIT RATINGS V |
|---|---|---|
| ROCKER ARM COVER (7.0 MIN) | 6.75 | 9.30 |
| FRONT SEAL HOUSING | 9.00 | 9.70 |
| OIL PAN | 9.02 | 9.46 |
| VALVE DECK | 8.66 | 9.60 |
| UNDERSIDE OF BLOCK | 9.38 | 9.49 |
| CAM COVER BAFFLE | 6.73 | 9.45 |
| AVERAGE ENGINE (9.0 MIN) | 8.26 | 9.50 |

The curves A, B, C, D, E, F and G as indicated above, illustrate the sludge factors of the lubricant additives described above and produced according to the present invention. The curves are derived from the data of Tables V, VI and VIII.

The curves A, B, etc., provided below are for the following sludge factors:

CURVE A: Rocker Arm Covers Sludge Predictions For Binary Mixture Observed And Calculated Values;

CURVE B: Front Seal Housing Sludge Predictions From Binary mixture observed and Calculated Values CURVE C: Oil Pan Sludge Predictions For Binary Mixture Observed and Calculated Values

TABLE IX

SIMPLEX MODEL OF SEQUENCE VE SLUDGE RATINGS (5 TEST PLUS 2 CHECK RUNS)

| RATING AREA | COEFFICIENTS AND T PROBABILITY B(1) | PROB > T | B(12) | PROB > T | B(2) | PROB > T | RANDOM ERROR |
|---|---|---|---|---|---|---|---|
| ROCKER ARM COVER | 5.84 | 0.0005 | 5.39 | 0.0655 | 9.34 | 0.0001 | 0.3726 |
| FRONT SEAL HOUSING | 8.92 | 0.0001 | 0.78 | 0.2794 | 9.74 | 0.0001 | 0.0321 |
| OIL PAN | 7.32 | 0.0001 | 4.09 | 0.0119 | 9.42 | 0.0001 | 0.0709 |
| VALVE DECK | 6.56 | 0.0001 | 5.74 | 0.0023 | 9.58 | 0.0001 | 0.1392 |
| UNDERSIDE OF BLOCK | 7.40 | 0.0001 | 4.89 | 0.0202 | 9.46 | 0.0001 | 0.1392 |
| CAM COVER BAFFLE | 7.18 | 0.0009 | 2.19 | 0555150 | 9.56 | 0.0001 | 0.7527 |
| AVERAGE ENGINE | 7.21 | 0.0001 | 3.83 | 0.0047 | 9.52 | 0.0001 | 0.0367 |

TABLE X

VISCOMETRIC DATA OF LEPSAD AND PIBSAD

| TEST FORMULATIONS | COMPOSITION (WT. %) I | II | III | IV | V |
|---|---|---|---|---|---|
| KIN VIS (CST), 100° C. | 9.45 | 10.14 | 10.82 | 11.73 | 12.98 |
| 40° C. | 69.80 | 75.22 | 81.40 | 94.50 | 102.50 |
| CCS (CP @ −15° C.) | 3750 | 3600 | 3550 | 3500 | 3400 |

TABLE XI 5W-30 FORMULATIONS FOR VISCOMETRIC STUDIES

| TEST FORMULATIONS | COMPOSITION (WT. %) VI | VII |
|---|---|---|
| PIBSAD (Example 4) | 7.125 | 3.000 |
| LEPSAD (Example 1) | — | 3.000 |
| VI IMPROVER | 8.000 | 5.500 |
| SNO-100 (+10 POUR) | 59.745 | 70.864 |
| PAO | 20.000 | 12.506 |
| BASE BLEND | BALANCE | BALANCE |
| % SNO-100 | 74.92% | 85.00% |
| % PAO | 25.08% | 15.00% |
| KIN VIS (CST) | | |
| 100° C. | 10.06 | 9.8 |
| 40° | 59.4 | 58.4 |
| CCS, −25° C. (CP) | 2790 | 2930 |

CURVE D: Valve Deck Sludge Predictions For Binary Mixture Observed and Calculated Values CURVE E: Underside of Block Sludged Predictions for Binary Mixture Observed and Calculated Values CURVE F: Cam Cover Baffle Sludge Predictions For Binary Mixture Observed and Calculated Values CURVE G: Average Engine Sludge Predictions for Binary Mixture Observed and Calculated Values In curve "G", the synergistic effect of the dispersants PIBSAD and LEPSAD is illustrated. In the illustration the letter symbols of $Y_s$, S and $Y_L$ are:

$Y_s$ The Curve Showing Synergism;

S is the Synergism; and $Y_L$ is the linear relationship if there were no synergism. The letter symbols are represented by the formulas:

$$Y_s=(B1)\ (X1)+(B2)(X2)+(B12)\ (X1)\ (X2)$$

$$S=\tfrac{1}{4}\ (B12)$$

$Y_L$=Linear relationship if there were no synergism.

We claim:

1. A lubricating oil composition comprising:

(a) a major amount of an oil of lubricating viscosity; and (b) a minor amount of a synergistic combination of an antioxidant-dispersant additive and a dispersant additive, said combination comprising:

(i) a polyisobutylene succinimide represented by the formula:

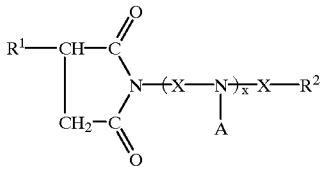

in which $R^1$ is a hydrocarbyl radical having from about 8 to 800 carbon atoms, X is a divalent alkylene or secondary hydroxy substituted alkylene radical having from 2 to 3 carbon atoms, A is a hydrogen or a hydroxyacyl radical selected from the group consisting of glycol, lactyl, 2-hydroxy-methyl propionyl and 2,2'-bishydroxymethyl propionyl radicals and in which at least 30 percent of said radicals represented by A are said hydroxyacyl radicals, X is a number from 1 to 6, and $R^2$ is a radical selected from the group consisting of —$NH_2$, —NHA or a hydrocarbyl substituted succinyl radical having the formula

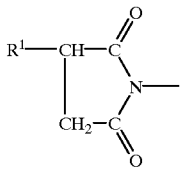

in which $R^1$ is as defined above; and (ii) an ethylene-propylene succinimide composition prepared by the steps comprising;

(A) reacting a polymer prepared from ethylene and at least one $C_3$ to $C_{10}$ alpha-monoolefin and, optionally, a polyene selected from non-conjugated dienes and trienes comprising from about 15 to 80 mole percent of ethylene, from about 20 to 85 mole percent of said $C_3$ to $C_{10}$ alpha-monoolefin and from about 0 to 15 mole percent of said polyene, said polymer having a number average molecular weight ranging above 80,000, with an excess in equivalence of an olefinic carboxylic acid acylating agent per equivalent weight of said polymer, said process comprising heating said polymer to a molten condition at a temperature in the range of 250° C. to 450° C. and, simultaneously, or sequentially in any order, reducing the molecular weight of said polymer with mechanical shearing means and grafting said olefinic carboxylic acylating agent onto said polymer, thereby producing a grafted, reduced molecular weight polymer having a number average molecular weight ranging from 5,500 to 50,000 and having at least 1.8 molecules of said carboxylic acid acylating function grafted onto each copolymer molecule of said reduced polymer, and (B) reacting said grafted, reduced polymer in (A) with an N-arylphenylenediamine represented by the formula:

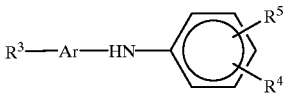

in which Ar is an aromatic hydrocarbon radical; $R^3$ is hydrogen, —NH-aryl, NH-arylalkyl or a branched or straight chain radical having from 4 to 24 carbon atoms that can be alkyl, alkenyl, alkoxyl, arylalkyl, alkylaryl, hydroxyalkyl or aminoalkyl; $R^4$ is —$NH_2$, —$[NH(CH_2)_n—]_m—NH_2$, —$CH_2—(CH_2)_n—NH_2$, —$CH_2$-aryl-$NH_2$ in which n and m each have a value of from 1 to 10; and $R^5$ is hydrogen, or an alkyl, alkenyl, alkoxyl, arylalkyl, or alkylaryl radical having 4 to 24 carbon atoms.

2. A composition according to claim 1 (ii) in which said reaction comprises heating said polymer to a molten condition, mixing said olefinic carboxylic acylating agent with said polymer and subjecting said mixture in the absence of a solvent to mechanical shearing means to graft said olefinic carboxylic acylating agent onto said polymer and reduce the molecular weight of said polymer to a range from 5,500 to 50,000.

3. A composition according to claim 1 (ii) in which said grafted reduced polymer has a number average molecular weight from about 6,000 to 20,000.

4. A composition according to claim 1 (ii) in which said grafted reduced polymer has a number average molecular weight from about 7,000 to 15,000.

5. A composition according to claim 1 (ii) in which said grafted reduced polymer comprises from about 25 to 75 mole percent ethylene and from about 25 to 75 mole percent of a ($C_3$–$C_8$) alpha-monoolefin.

6. A composition according to claim 1 (ii) in which said polymer comprises from about 40 to 65 mole percent ethylene and from about 35 to 60 mole percent of propylene.

7. A composition according to claim 1 (ii) in which said olefinic carboxylic acid acylating agent is maleic anhydride.

8. A composition according to claim 1 (ii) in which said N-arylphenylenediamine compound is an N-phenylphenylenediamine.

9. A composition according to claim 1 (ii) in which said grafted reduced polymer has from about 1.8 to 5 molecules of said carboxylic acid acylating function per molecule of said polymer.

10. A composition according to claim 1 (ii) in which grafted reduced polymer has from about 2.25 to 4 molecules of said carboxylic acid acylating function per molecule of said polymer.

11. A composition according to claim 1 (ii) in which said grafted reduced polymer has from about 2.5 to 3.75 molecules of said carboxylic acid acylating function per molecule of said reduced polymer.

12. A composition according to claim 1 (ii) in which the mechanical shearing means for the reaction between said polymer and said carboxylic acid acylating agent is an extruder.

13. An additive composition according to claim 1 (ii) in which said N-arylphenylenediamine is N-phenyl-1,4-phenylenediamine.

14. An additive composition according to claim 1 (ii) in which said N-arylphenylenediamine is N-phenyl-1,3-phenylenediamine.

15. A hydrocarbyl-substituted mono-and bis-succinimide according to claim 1 (i) in which at least 50 percent of said radicals represented by A are hydroxyacyl radicals.

16. A hydrocarbyl-substituted mono- and bis-succinimide according to claim 1 (i) in which substantially all of said radicals represented by A are hydroxyacyl radicals.

17. A hydrocarbyl-substituted mono-and bis-succinimide according to claim 1 (i) in which at least 30 percent of said radicals represented by A are glycolyl radicals.

18. A hydrocarbyl-substituted mono- and bis-succinimide according to claim 1 (i) in which at least 30 percent of said radicals represented by A are lactyl radicals.

19. An alkenyl succinimide according to claim 1 (i) in which 85 to 100 percent of said radicals represented by A are glycolyl radicals.

20. The lubricating oil composition of claim 1, wherein the concentration of said polyisobutylene succinimide and ethylene-propylene succinimide additives ranges from about 0.1 to about 30 wt. % based on the total weight of said oil composition.

21. The lubricating oil composition of claim 1, wherein the concentration of said polyisobutylene succinimide and ethylene-propylene succinimide additives ranges from about 0.5 to about 15 wt. %.

22. The lubricating oil composition of claim 1, wherein said polyisobutylene succinimide and ethylene-propylene succinimide additives concentration ranges from about 1.0 to about 7.5 wt. %.

23. The lubricating oil composition of claim 1, wherein the concentration of said ethylene-propylene succinimide is about 1.0 to about 5.0 wt. % and said polyisobutylene succinimide is about 1.0 to about 5.0 wt. % based on the total weight of said oil composition.

* * * * *

UNITED STATES PATENT AND TRADEMARK OFFICE

CERTIFICATE OF CORRECTION

PATENT NO : 6,117,825

DATED : September 12, 2000

INVENTOR(S) :

It is certified that error appears in the above-identified patent and that said Letters Patent are hereby corrected as shown below:

Column 1, line 8,9: Change "Roy Isamu Yamamota" to "Roy Isamu Yamamoto"

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*